United States Patent [19]

Wills

[11] 4,408,183

[45] Oct. 4, 1983

[54] EXERCISE MONITORING DEVICE

[76] Inventor: Thomas A. Wills, 2113 Mt. Vernon St., Philadelphia, Pa. 19103

[21] Appl. No.: 803,593

[22] Filed: Jun. 6, 1977

[51] Int. Cl.[3] ..... G08B 5/00; A63B 23/00

[52] U.S. Cl. ..... 340/323 R; 272/DIG. 5; 272/DIG. 6; 273/86 B

[58] Field of Search ..... 340/323 R; 35/29 R; 272/DIG. 5, DIG. 6, 93, 100; 273/86 B; 235/92 GA, 92 CA, 92 FQ; 324/161; 128/2.1 A, 903, 904; 364/410, 413

[56] References Cited

U.S. PATENT DOCUMENTS

| | | | |
|---|---|---|---|
| 3,454,942 | 7/1969 | Chamberlin et al. | 340/323 R |
| 3,735,101 | 5/1973 | Stewart | 340/323 R |
| 3,797,010 | 3/1974 | Adler et al. | 340/323 R |
| 3,834,702 | 9/1974 | Bliss | 273/86 B |
| 3,846,704 | 11/1974 | Bessette | 340/323 R |
| 3,848,467 | 11/1974 | Flavell | 272/DIG. 5 |
| 4,048,474 | 9/1977 | Olesen | 235/92 FQ |
| 4,093,849 | 6/1978 | Baxter et al. | 235/92 PC |

OTHER PUBLICATIONS

Zilog, "Z80-CPU Technical Manual", 1976.

*Popular Electronics,* Mar. 1978, "Jogging Computer".

*Fortune,* "Keeping Fit in the Company Gym", Oct. 1975, pp. 136-143.

*Primary Examiner*—James J. Groody

*Attorney, Agent, or Firm*—Dann, Dorfman, Herrell and Skillman

[57] ABSTRACT

A display device is coordinated with a keyboard which permits a preselection of time and effort to be spent in a given repetitive physical exercise. The display graphically compares the elapsed time on a scale of total time to be taken with proportion of the total repetitions of exercise performed on a comparable scale representative of total repetition to the exercise. Thus, the display shows the relative pace of the exerciser so that the person doing the exercise can see whether or not he is keeping up the pace which he has set for himself. A preferred display uses adjacent parallel bar graphs which progressively become visible as time expires and the exercise is performed to permit a direct comparison of the bar graphs. A suitable computation device sets the bar graph scales in accordance with the keyboard inputs. A pickup transducer of appropriate type is used to display the proportional part of the repetitive exercise already done and is coordinated to start with the display real time on appropriate scale for the total elapsed time selected which corresponds exactly with the scale showing total number of repetitions to be completed in that time.

7 Claims, 3 Drawing Figures

EXERCISE MONITORING DEVICE

The present invention relates to an exercise monitoring or repetitive process monitoring device which is visually monitored by the user as he does repetitive exercise. The device is one in which the user selects the rate at which he wishes to pursue his exercise and then as the exercise is started his rate of accomplishment is compared with a real time scale to determine whether he is maintaining the proper pace.

In the prior art various devices to display rate of physical activity have been proposed, but no device to date has had the capability of permitting the user to set his own predetermined pace and monitor that pace on a display. In particular, the display shows graphically, for the first time, the proportional part of the repetitive exercise performed compared to the elapsed time displayed as a proportional part of selected total time. As the result, the two displays, as they are generated, effectively show whether the rate at which the exercise is being performed is being performed at the preferred constant rate. In accordance with the present invention, a computer device is programmed by manually selecting the total elapsed time, which determines the time scale of the clock display; then manually selecting the number of repetitions of the exercise to be performed. Both of these inputs are preferably made by use of a keyboard. Appropriate indicators show total time selected by pushing a "time" button and then pushing in series the numbers representative of the total time selected. Then an "effort" button is pushed and the total number of repetitions of the exercise is serially punched into the keyboard, for example. Each of these manipulations, in turn, stores the needed information in the memory from which a scale setting computes and sets the scale of the display. A pickup transducer is provided in such a form that it will detect the repetitive movements of an exercise and provide pulses to a counter which counts the number of times the exercise is repeated and relates the count to a display output representative of expended effort. This is done concurrently with the exercise in order to drive the display of the part of the total exercise performed on a current basis. A similar display graphs elapsed time on a scale representative of the total selected time. The system may be started by the pickup transducer recording the first occurrence of the repetitive exercise and starting the clock. At the same time the clock display relentlessly advances with time at a steady rate, each repetition of the exercise causes the pickup transducer to pulse the system to add to the parallel display. It is the direct comparison of the two displays which constantly advises the exerciser viewer whether or not he is keeping pace with his predetermined goal which he has just selected and punched into the keyboard of the machine.

For a better understanding of the present invention, reference is made to the following drawings in which.

Figure 1:
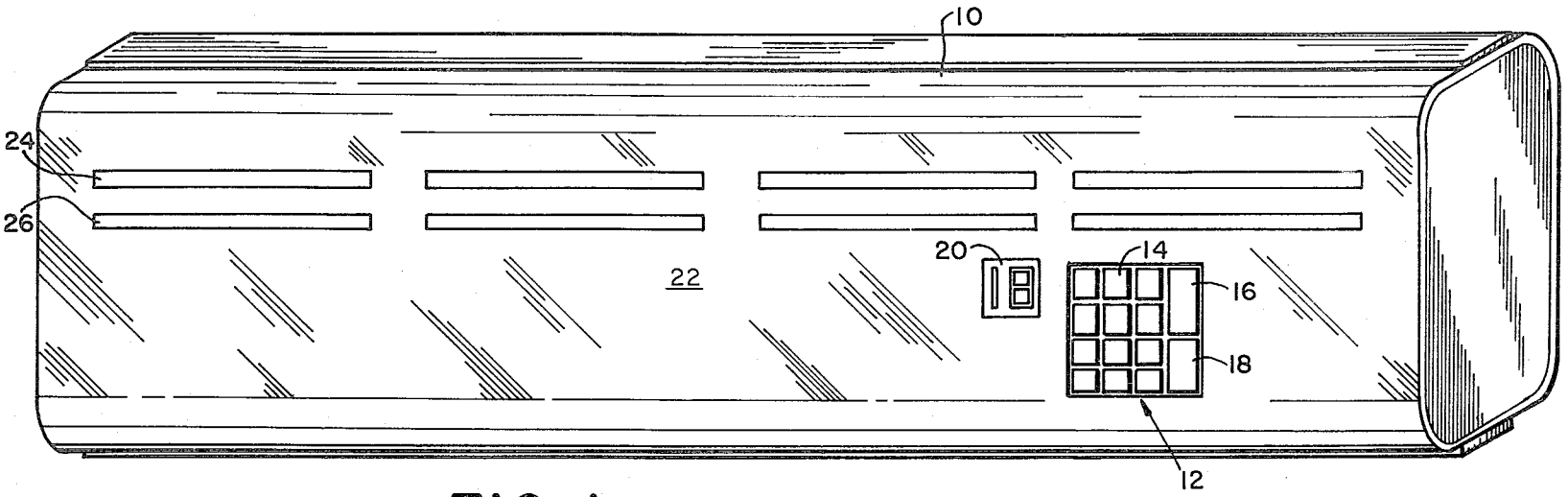
FIG. 1 is a view of a display panel in accordance with the present invention.
Figure 2:
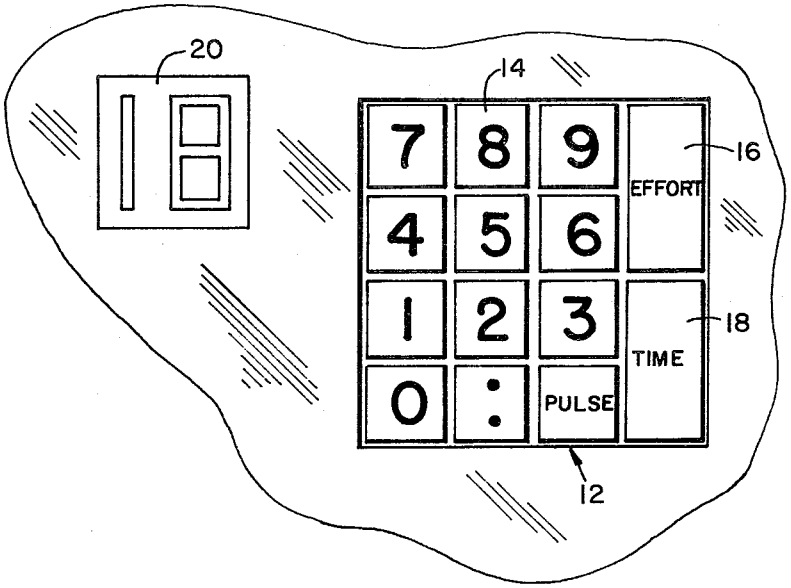
FIG. 2 is an enlargement of the selection panel or keyboard for the display panel.

Referring to FIG. 1, the present invention involves the use of a display device which may be in the form of a elongated box enclosure 10 containing appropriate electronics within the enclosure and suitable displays on its front face positioned to be viewed by the exerciser. The front face of enclosure 10 is provided with a selection panel 12 which has a numbered keys 14 arranged in a matrix which permits a selected number to be serially punched into the computer or memory storage using a sequence of pushbuttons to make a manual connection, record on punch tape or magnetic tape or generate tone or pulse codes to provide sequential quantitative information to a scale represented by the number selected. The numbered keys 14 may be used in a manner similar to a touchtone telephone dialing keyboard, with the selected numbers punched in sequence in the same way. The selection panel also includes a push button 18 to set the memory to receive a selected number from keys 14 representing a total time. A pushbutton 16 on the selection panel 12 sets the memory to receive a selected number from keys 14 to represent the effort to be expended in terms of the total number of repetitious movements of the exercise for the selected time. For example, if the time is to be represented in seconds, one wishing to do fifty deep kneebends in two minutes would first push the time button 18 then sequentially push the numbered keys 14 representative of 1, 2, and 0 to indicate the number of seconds. Then he would push the effort button 16, following which he would push sequentially the 5 and 0 keys of keys 14, representing the number of kneebends (or other repetitive exercise) to be accomplished. A visual display 20 showing the time selected and a similar visual display 22 showing the effort selected be provided, preferably adjacent to the effort and time buttons 16 and 18, respectively.

The active input to the device is a remote pickup transducer positioned to pick up a selected repetitive action of the exercise and transmit it to the computer. Each pulse picked up registers a cycle, or possible two repetitions represent a cycle or whatever is appropriate in particular exercise. Thus, for example, the transducer in the deep kneebend situation might be one in which a photocell is triggered by a lightbeam which is interrupted by the movement of some part of the body through the light or exposing the light. Alternatively, the transducer may be coupled to the body to sense the pulse rate of the individual preferring the exercise as the "effort" input. Having set the time and effort inputs, the user prepares himself to use the device and begins his exercise. If desired, a manual start switch 38, accessible to the exerciser, may be positioned on a separate structure 40 remote from display 22 to be readily manually actuated as the user starts his exercise. The pickup transducer will record the first cycle and start the clock to generate the time display and the pickup transducer will cause the generation of the effort display. The time setting will effectively cause the clock to use a proportional part of the total time scale provided. The effort will cause each repetition of the exercise to display a proportional piece of the total scale. The comparative display of the two scales will show whether the effort is keeping pace with the time scale and allow the user to speed or slow his pace. If desired, the time scale may be provided with scale numbers which are either illuminated prior to the bar appearing, or illuminate in sequence as the bar appears. Similarly, the effort scale may be provided with numerical scaling points, if desired.

The present invention also has a geometrical display featuring two similar geometrical forms which are generated respectively as time elapses and effort is expended. In preferred embodiments of the invention, the display may be two parallel bar graphs 24 and 26 representing respectively time and effort. Electronically, these devices can be Burroughs bar graph displays or such displays as aligned rows of sequentially illuminated light emitting diodes, or they can be any other suitable type of electronic or mechanical display, if that is preferred. Whatever the means of generating the displays, the display is intended to represent time elapsed by the bar extension which extends in direct proportion to time elapse in response to a suitable output from a clock. The second display employs a bar which extends a fixed increment of length with each cycle of activity or effort of the user monitored by the pickup transducer. Assuming that the bar display 24 represents time, the total selected time elapse for the total exercise would be selected for the full scale or the entire bar display. The computer of the system operates the bar graph display such that increments of length are added to the illuminated display bar 24 at a constant rate as the time elapses. Similarly, each repetition of effort constitutes a fixed proportion of the whole effort that was selected by pushbuttons and the computer to represent the full scale of the effort bar display. The computer provides for an addition proportional part of the whole to be displayed on the bar graph as the effort is detected by the transducer. By comparison of the time elapsed and the effort expended, one performing the exercise can tell whether he is keeping pace with the prescribed time in the course of his effort, and he can either slow or hurry the exercise in order to keep pace. In some exercises this is very important since it is not merely performing the exercise, but the rate at which the exercise is performed, which is important. Concurrently with the energization of the displays 24 and 26, the digital display 20 is preferrably activated.

Figure 3:
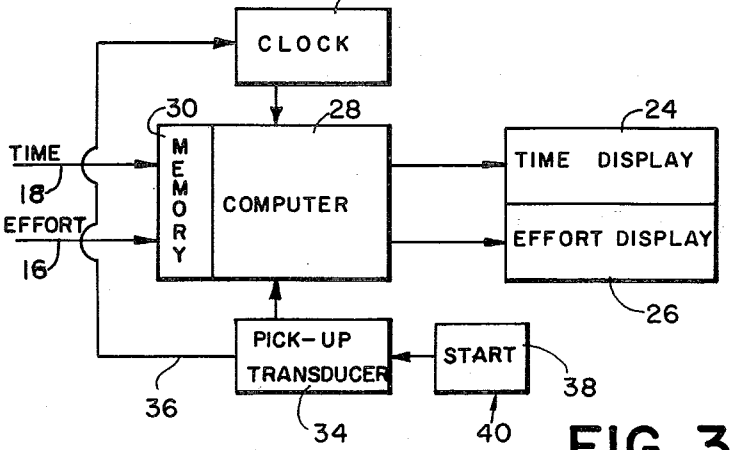
FIG. 3 is a block diagram showing schematically the structure of the present invention.

Turning now to FIG. 3, the diagram illustrates in block form schematically and functionally what is accomplished by the apparatus of the present invention. There are many variations of systems which could accomplish the desired results, including purely mechanical systems, but modern electronics packaging is so compact that it is of great advantage to use conventional electronics which is assumed for the functional boxes of the block diagram of FIG. 3. In the diagram, we see the parallel displays 24 and 26 which are fed by a common computer 28. The computer 28, for example, might be a Zilog Z80-CPU. The scale of the display is first set in accordance with information placed in its memory 30. Time is placed in the memory by operation of pushbutton 18 followed by sequential selection of numbers on the keyboard 14, which number is stored in memory 30 for later use. Similarly, effort is selected for recording in the computer memory by operation of pushbutton 16, followed by sequential selection of the number of repetitive exercise operations selected on the keyboard 14 and stored in the memory 30. The immediate use of the selected time and effort numbers is to post them in a display 20 shown in FIG. 1. They also operate on the computer to set the full scales in accordance with these numbers input. An electronic clock in the form of a pulse generator timer 32 provides the computer 28 with real time. The computer assigns a time to the full length of the bar graph display 24, or some predetermined portion of it. Selection either before the start of the timer 32, or in the course of it, to display a scale, and in the course of it, an indication of the scale may be displayed in synchronism with generation of the bar graph as desired, or the whole scale may be presented at one time. In any event, if time has been selected as a total of five minutes, for example, then the whole length of this bar graph will represent a period of five minutes, or some selection portion of the bar graph will represent that elapsed time.

As previously indicated, the pickup indicator 34 or pickup transducer may be any type of conventional device. For example, a photoelectric pickup cell has been described. Such a device is desirable in that no physical contact with a mechanical part is needed. The function of the transducer is to generate a pulse upon reoccurance of some predetermined part of the repetitive exercise. The transducer 34 can be made effective when the first of the repetitive occurances is detected by the transducer 34. The clock may then be started through a bypass 36 to clock 32 which, in turn, starts generating a fixed frequency of pulses which may be used to generate a time scale on a bar graph. Of course, it will be understood that in certain circumstances the pickup transducer 34 may be used in applications that count several pulses in the course of a single cycle in a repetitive exercise. Depending upon the transducer position, and the nature of the exercise, a portional part of the bar graph will be generated with each pulse. While alternatively a predetermined number of pulses can be accumulated for each cycle of movements of the exercise. In any event, the display 26 will show the proportional part of the exercise which has been completed. If the two bar graphs do not keep pace, the exerciser will know that he is not performing at the pace which he has set for himself. Of course, it will be understood that, if the time display moves ahead of the effort display, the effort is not being performed as fast as programmed, and, if the effort display is ahead of the time display, the effort is being performed too fast, and the exerciser should slow down to keep a proper pace.

As previously suggested, it is possible to simulate this whole arrangement in a mechanical device and other types of electrical or electronic arrangements are also possible for the device. In concept, however, the device gives the user the advantage of a visual display so that he can know at all times whether he is maintaining the rate of effort which was predetermined by him or for him.

The displays may vary considerably from bar graphs. For example, pie graphs may be quite helpful. Any other geometrical shape might be possible.

Other modifications include modifications of the keyboard format and in the last analysis, a magnetic pickup is useful. Such a pickup might use a magnetic card as an input to automatically select time and effort without the use of pushbuttons. Other means of fully or partially automating a device can be selected.

Another area where modification is possible is in connection with non-linear scales, such as where a non-uniform rate of exercise on a particular curve is used. Such a non-uniform rate could be programmed into the counter.

Applications, too, vary depending upon needs. Sport self-monitoring uses are covered by the specific embodiment. Multiple bar graphs may be used to compare many athletes. For example, monitoring multiple swimmers may be accomplished on a single panel having multiple rows of bar displays for a common comparison of all. Nor are applications confined to exercise and sports applications. Time and motion study experts may find a device of the present invention useful not only in analyzing human performance, but also in analyzing machine operations which may be more difficult to deal with than people. Other applications will occur to those skilled in the art.

Various modifications have been suggested. All such modifications within the scope of the claims are intended to be within the scope and spirit of the present invention.

I claim:

1. A monitoring device enabling a human user to compare elapsed time with effort performed comprising:

separate graph generating means which are similar in nature to provide generation of graph patterns in proportion to elapsed time and in proportion to effort, respectively, and positioned adjacent and relative to one another such that the elapsed time and effort generations can be visually directly compared, clock means generating repetitive timing signals, pickup transducer means sensing efforts and generating signals representative thereof, and connected by linkage means for starting the clock means by an initiating impulse, completed effort cycle selection means to select a scale for the effort graph pattern, time period selection means to select the scale of the total elapsed time graph pattern, and selective activation means, including computer means, connected to and permitting the respective graph patterns to receive and record timing signals from the clock means and effort signals from the pickup transducer means.

2. The device of claim 1 in which the respective selection means set the total number of repetitious efforts to be performed as full scale for the effort graph pattern and total time period as full scale for the elapsed time graph pattern.

3. The monitoring device of claim 1 in which a proportional part of full scale is generated on the graph pattern for each effort performed.

4. The device of claim 3 in which a manual start button is provided to energize the pickup transducer.

5. The device of claim 3 in which a manual start button is provided to energize the pickup transducer manually and the same start button renders the pickup transducer active.

6. The device of claim 1 in which the clock means is an electronic pulse generator having a uniform output with time.

7. The device of claim 1 in which the clock means is an electronic pulse generator having a predetermined pattern of non-uniformity with time.

* * * * *